US012270217B2

(12) United States Patent
Brezan et al.

(10) Patent No.: US 12,270,217 B2
(45) Date of Patent: Apr. 8, 2025

(54) HIGH PRESSURE INFLATABLE BEAM

(71) Applicant: ZEPELIN, S.R.O., Trenčín (SK)

(72) Inventors: Juraj Brezan, Trenčín (SK); Henrich Hodák, Trenčín (SK); Pavol Ochodnický, Trenčín (SK)

(73) Assignee: ZEPELIN, S.R.O., Trencin (SK)

( * ) Notice: Subject to any disclaimer, the term of this patent is extended or adjusted under 35 U.S.C. 154(b) by 0 days.

(21) Appl. No.: 16/972,874

(22) PCT Filed: Jun. 8, 2019

(86) PCT No.: PCT/SK2019/050006
§ 371 (c)(1),
(2) Date: Dec. 7, 2020

(87) PCT Pub. No.: WO2019/236014
PCT Pub. Date: Dec. 12, 2019

(65) Prior Publication Data

US 2021/0246685 A1 Aug. 12, 2021

(30) Foreign Application Priority Data

Jun. 8, 2018 (SK) ..... 50059-2018 U

(51) Int. Cl.
*E04H 15/20* (2006.01)
*E04H 15/36* (2006.01)
(Continued)

(52) U.S. Cl.
CPC ..... *E04H 15/20* (2013.01); *E04H 15/36* (2013.01); *E04H 2015/201* (2013.01); *E04H 15/44* (2013.01); *E04H 15/48* (2013.01)

(58) Field of Classification Search
CPC ... E04H 15/20; E04H 2015/201; E04H 15/36; E04H 15/44; E04H 15/48
See application file for complete search history.

(56) References Cited

U.S. PATENT DOCUMENTS 2,682,274 A * 6/1954 Miller ..... E04H 15/20 52/2.13
3,580,289 A * 5/1971 James, Jr. ..... B29D 23/001 138/123

(Continued)

FOREIGN PATENT DOCUMENTS

DE 4421080 A1 * 12/1995 ..... E04H 15/20
DE 202016104291 8/2016

(Continued)

OTHER PUBLICATIONS

Zepelin, S.R.O.; International Patent Application No. PCT/SK2019/050006; International Search Report: Oct. 16, 2019; (2 pages).

*Primary Examiner* — Phi D A
(74) *Attorney, Agent, or Firm* — Dority & Manning, P.A.

(57) ABSTRACT

A high pressure inflatable beam (1) with a typical internal operating pressure in the range of 100 to 1,000 kPa, formed from conventional or modified fire hoses, or other industrial hoses or tubes produced by seamless braiding technology with an internal lining impervious to air and a possible outer protective coat, the ends of which are closed by a plug, wherein at least one plug contains at least one filling and/or discharging element for the filling medium, and the ends of the beam (1) are firmly put in at a distance of less than the total length of the beam (1), where at least one a section of its length, the beam (1) is provided with at least two adjoining fixed attachment points (2) located in the longitudinal direction of the beam (1) and formed on the surface of the beam (1) or sleeves (5) of the beam (1), wherein the fixed attachment points (2) are interconnected by at least one force exerting element (3), whose straight length between the fixed attachment points (2) is shorter than the straight length of the plain beam (1) between these fixed attachment points (2).

11 Claims, 4 Drawing Sheets

(51) Int. Cl.
*E04H 15/44* (2006.01)
*E04H 15/48* (2006.01)

(56) References Cited

U.S. PATENT DOCUMENTS 3,599,677 A * 8/1971 O'Brien ..... F16L 11/12 138/121
3,886,980 A * 6/1975 Elson ..... D04C 1/02 138/143
4,068,418 A * 1/1978 Masse ..... E04H 15/20 52/2.21
4,197,681 A * 4/1980 Holcombe ..... E04C 3/005 52/2.21
4,877,044 A * 10/1989 Cantwell ..... E04H 15/60 135/120.3
5,205,086 A * 4/1993 Heim ..... E04H 15/20 135/156
5,421,128 A * 6/1995 Sharpless ..... B64C 3/30 52/2.13
5,546,707 A * 8/1996 Caruso ..... E04C 3/29 52/2.21
5,570,544 A * 11/1996 Hale ..... E04H 15/20 52/2.11
5,579,609 A * 12/1996 Sallee ..... H01Q 1/428 52/2.13
5,677,023 A * 10/1997 Brown ..... E04H 15/20 428/36.6
5,735,083 A * 4/1998 Brown ..... E04C 3/005 52/2.13
6,182,398 B1 * 2/2001 Head ..... D04C 1/06 52/2.13
7,096,874 B2 * 8/2006 Forshpan ..... A47D 15/00 135/117
10,314,410 B2 * 6/2019 Myers ..... A47D 13/00
2002/0083653 A1 7/2002 Hilbert
2009/0084043 A1 * 4/2009 Tarbet ..... E04H 15/20 52/741.1
2016/0305149 A1 * 10/2016 Brezan ..... E04H 15/54
2019/0376310 A1 * 12/2019 Warner ..... E04C 3/28

FOREIGN PATENT DOCUMENTS

EP 0042582 A1 * 12/1981
EP 1229187 A1 * 8/2002 ..... E04H 15/20
EP 3786394 A1 * 3/2021 ..... E04H 15/642
FR 2341017 A1 * 9/1977 ..... E04H 15/20
JP 2001082004 A * 3/2001
WO WO90/15208 A1 12/1990
WO WO-2013185262 A1 * 12/2013 ..... E04H 15/20
WO WO-2014163564 A1 * 10/2014 ..... E04H 15/20
WO WO2014168591 A1 10/2014
WO WO-2015044652 A2 * 4/2015 ..... D04C 1/06
WO WO-2020165549 A1 * 8/2020 ..... E01F 8/0088
WO WO-2020197415 A1 * 10/2020 ..... E04H 15/20

* cited by examiner

HIGH PRESSURE INFLATABLE BEAM

This application is a National Stage Patent Application of PCT/SK2019/050006, filed on Jun. 8, 2019, which claims the benefit of priority to Slovakian Patent Application No. PUV50059-2018, filed on Jun. 8, 2018, the disclosures of all of which are incorporated by reference herein in their entireties.

TECHNICAL FIELD

The technical solution relates to inflatable beams for structures above ground, in particular for forming temporary roofings such as tents, tunnels, podiums and other typical and atypical roofings, for forming ancillary structures for attachment and suspension of technology, for securing another fixed or inflatable structure against a fall, or as separate inflatable objects.

BACKGROUND ART

High-pressure inflatable beams filled with air or inert gas, with a typical internal operating pressure in the range of 100 to 1,000 kPa, are used as a load-bearing element of tents and temporary roofings, in which case they preferably use, as a construction element, conventional or modified fire or industrial hoses or other tubes produced using the technology of seamless braiding with an internal lining impervious to air and a possible surface finish.

The use of fire hoses as beams of a roof construction is presented in the document in EP 0810339. This solution makes it possible to provide temporary roofing by means of a structure comprising inflatable beams, preferably made of fire hoses. These hoses are connected at the ends to fixed supporting elements arranged in a row. When forming the covering of a space, solid supporting elements are placed at the edges of the space to be covered, and the elements also serve as elements for air distribution to the said hoses. Hoses are connected to these supporting elements by the respective ends and, after inflation, the hoses form an arch, or a row of arches, between the said supporting elements. A covering sheet is then attached to this row of arches. The above solution creates an arcuate covering that is open at the ends (a tunnel).

The document SK 6715 Y1 discloses a tent with an inflatable support structure, which tent uses an inflatable beam made of a standard fire or other industrial seamless hose with outer textile braiding, the hose being closed at each end by a plug, of which at least one comprises an air inlet or discharge element, and at least one end of the hose is attached to or supported on the outer skin of the tent or on the floor portion of the tent. The use of standard fire or other industrial seamless hoses with outer textile braiding and an internal lining impervious to air allows higher operating pressure without the need for pressure compensation by overpressure valves. The shape and overall size of the supporting structure of the tent is thus defined and constant even in cases of pressure fluctuations caused by a change in temperature or pressure of the external environment. Since the tent skin and the floor portion generally form one unit, or the ends of the hose are anchored to the floor, when inflated the hose is basically formed into an arcuate shape, more specifically in accordance with the shape predefined by the adapted cut of the outer skin and the floor portion.

The inflatable beams of the documents EP 0810339 and SK 6715 Y1 preferably provide a sufficiently rigid and stable supporting element to form a roofing of an area in the form of tunnel roofs or dome roofs or tents. The shape of the beam, and thus also the shape of the roof, is achieved by a fixed position of the elements—the bases, in which the beam ends are attached; after inflating the beam and spreading it between the bases, a continuously arcuate shape is created, defined by the ratio of the length of the hose (tube) and the span of the bases. Depending on the said ratio, the arch profile may have a semi-arcuate or elliptical shape.

A disadvantage of the prior art in the above described roof construction is basically the given arcuate shape of the inflatable beam. This reduces the application possibilities in cases where a beam profile other than a continuous arch is necessary for static or aesthetic reasons, where it is necessary to copy the shape of another object or where a better underpassability is necessary due to an unsuitable lead angle at the base of the beam.

The aim of this technical solution is a substantial elimination of the drawbacks of the prior art.

DISCLOSURE OF INVENTION

The said aim is achieved by an arcuate high pressure inflatable beam according to the present invention, with a typical internal operating pressure in the range of 100 to 1,000 kPa, formed from conventional or modified fire hoses, or other industrial hoses or tubes produced by seamless braiding technology with an internal lining impervious to air and a possible outer protective coat, the ends of which are closed by a plug, with at least one plug containing at least one filling and/or discharging element for the filling medium, and the ends of the beam are firmly put in at a distance of less than the total length of the beam, the essence of which lies in the fact that at least one a section of its length, the beam is provided with at least two adjoining fixed attachment points located in the longitudinal direction of the beam axis and formed on the surface of the beam, with the fixed attachment points being interconnected by at least one force exerting element whose straight length between the fixed attachment points is shorter than the straight length of the plain beam between these fixed attachment points.

The principle of a force exerting element ensuring a change in the shape of the beam consists in the forcible shortening of the inner circumference of the arcuate beam. This is achieved by fixing two or more points of the beam circumference to a distance that is less than the original distance between the given points before fixation. Depending on the ratio of such a contraction, the ratio of the distance between the circumferential yarns of the basic fabric of the tube changes after inflation of the beam. On the outer circumference of the beam, the yarns remain spaced to the maximum distance allowed by the fabric structure of the tube, while on the inner circumference of the beam distances between circumferential yarns of the basic fabric of the tube are reduced according to the ratio and manner in which the force exerting element is applied. If the contraction is severe, not only is there a reduction of the distance between the circumferential yarns, but also a fold comes into being on the tube surface. Thus, visually, depending on the ratio of contraction of the force exerting elements, the beam is bent or even kinked at the given point of action of the force exerting elements.

The fixed attachment points of the force exerting element may take the form of projections formed on the beam fabric during the process of braiding the tube or tube.

The fixed attachment points may also take the form of locally added material on the surface of the hose or tube. This may be formed using the technology of welding, sewing, gluing or other known technologies. The material locally added in this manner may also be around the entire circumference of the hose or tube in the form of a sleeve, which appears to be the most preferable solution. Such a hose sleeve encircles the outer circumference of the hose and can be made of a variety of suitable materials, such as metal, plastic, textile, composite, and the like. It is possible to apply two separate sleeves interconnected by a force exerting element. In the case of sleeves, it is possible for the force exerting element to be constituted by a continuous connection of the sleeves, which essentially creates one shaped sleeve with a preset bending angle.

Consequently, this technical solution requires at least one force exerting element attached at at least two points. In the case of placing the force exerting element in the inner arc of the beam, the element is acted upon mainly by tensile forces. The material for forming the force exerting element can thus be either a rigid shaped element made of materials such as metal, composite, plastic, wood and the like, or a tensile element made of materials such as textile, strap, rope, cord and the like. The rigid shaped element is more preferable for the purpose at hand because of better properties in the catching of lateral forces acting at the point of the bend of the beam. In the case of the positioning of the force exerting elements on the side of the beam or on the outer arc of the beam, both tensile and compressive forces are to be captured at the same time and the use of exclusively rigid materials capable of capturing both types of forces is presumed.

When the forces are greater or the beams are bigger, a combination of the placement of the force exerting elements on the beam, more specifically on the beam arc, and/or on the sides of the beam, and/or on the outer arc of the beam may be used preferably. One rigid shaped element or tensile element may be placed on the inner arc of the beam, at least one, preferably a pair of rigid force exerting elements may be placed on the side of the beam and one force exerting element may be placed on the outer arc of the beam. The force exerting element on the side of the beam and the outer arc of the beam has an angle corresponding to the angle of bending or angle of kinking of the beam. Of course, various other combinations of locations of the force exerting elements are also possible depending on the given design requirements for the purpose or placement of the beam.

Each single bend or kink of the beam requires its own force exerting element or system of force exerting elements. Thus, the resulting beam shape may be, for example, a combination of an arch with one kink in the middle, forming a gothic arch profile, a bend with two kinks at the sides, ensuring a sharper lead angle from its base and the associated better internal underpassability, or a combination of multiple kinks as far as it is advantageous for the application at hand.

To improve the form stability of the beam, it is possible to interconnect the points of attachment of the force exerting element, or force points formed elsewhere on the beam, using a chord.

BRIEF DESCRIPTION OF DRAWINGS

The technical solution is explained in more detail in the attached drawings, where.

MODE(S) FOR CARRYING OUT THE INVENTION

The arcuate high pressure inflatable beam 1 according to the present solution comprises one hose or tube made by seamless braiding technology with an internal lining impervious to air and a possible outer protective coat. This hose or tube is provided with air plugs at its ends.

Figure 1:
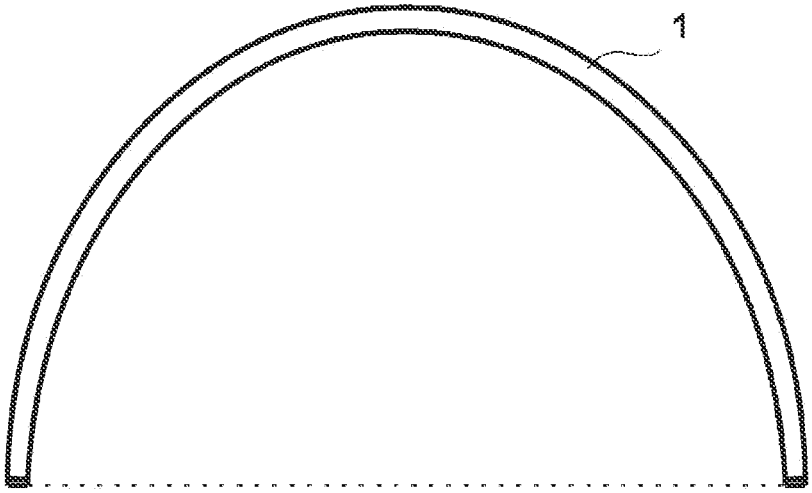
FIG. 1 is a schematic representation of a prior art arcuate high-pressure beam.

Due to the nature of its symmetrical structure, when no lateral forces act upon it, the high pressure inflatable hose or tube tends to maintain a straight shape when inflated and pressurized to operating pressure. For the purpose of using high pressure hoses or tubes as roofing beams, such as e.g. tents and the like, it is customary to use a hose or tube being longer than the planned distance between the attachments of its ends-bases. As a result of the fixation of the bases, this way the hose or tube is bent into a continuously arcuate shape forming part of a circle or ellipse, as shown in FIG. 1

Figure 2:
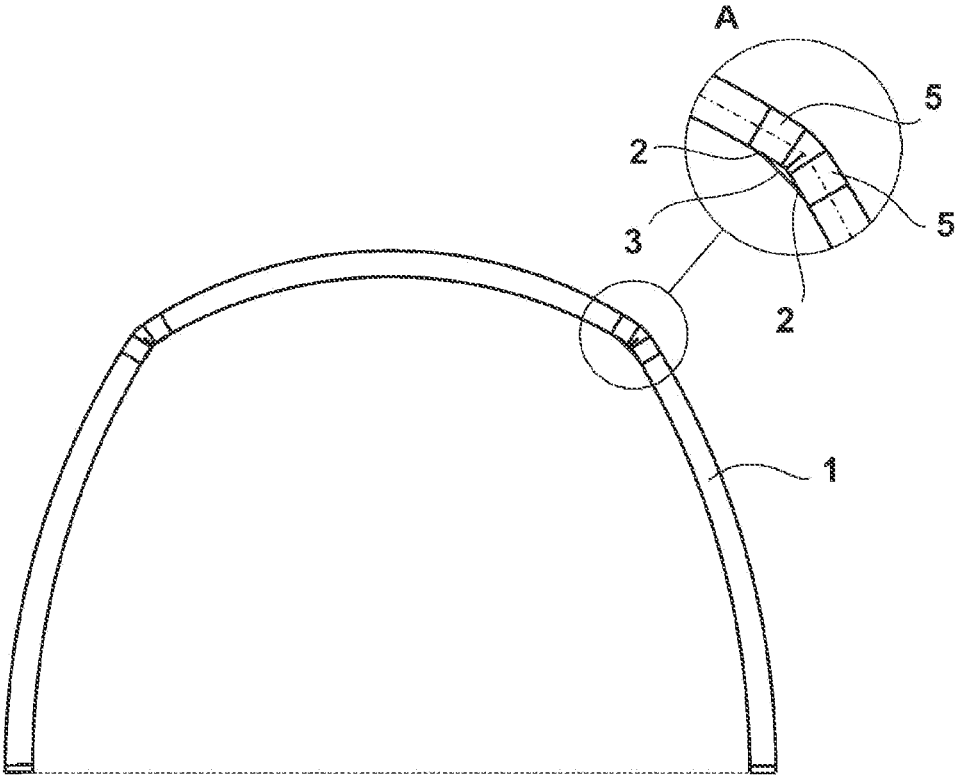
FIG. 2 is a schematic representation of an arcuate high pressure beam in one illustrative embodiment according to the technical solution with detail A of the bending or kinking of the beam.
Figure 5:
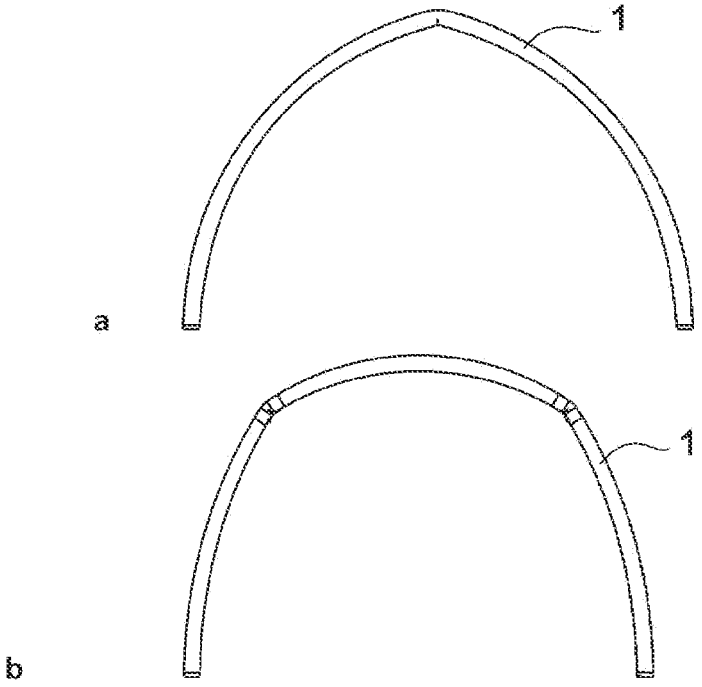
FIG. 5 is a schematic representation of variants a and b of illustrative embodiments of various beam shapes according to the present technical solution.
Figure 6:
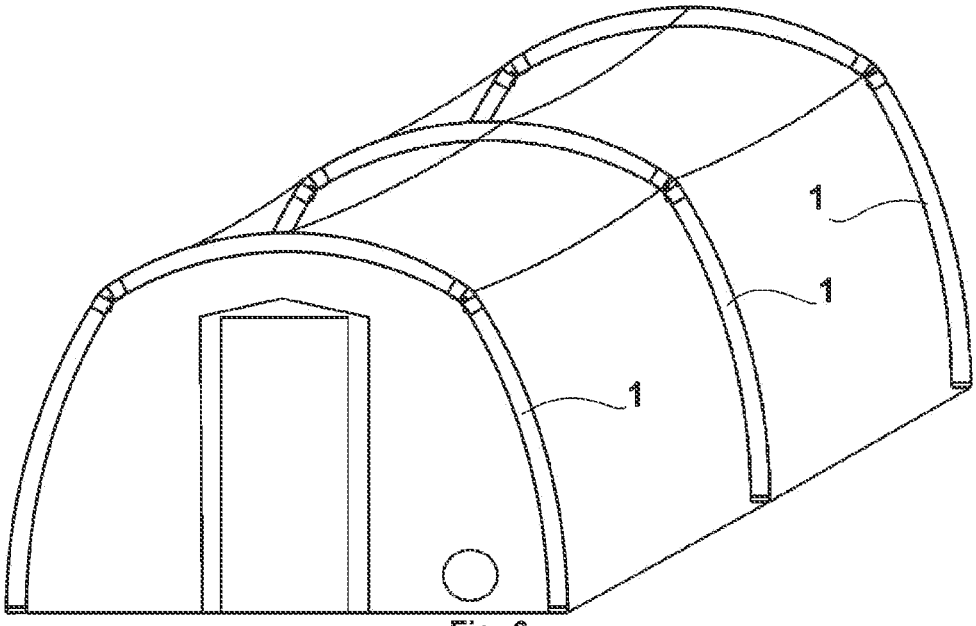
FIG. 6 shows an example of the application of a beam according to the present technical solution for a tunnel-type tent.

For changing the shape of this beam 1, as shown e.g. in FIG. 2, FIG. 5, and FIG. 6, at least two adjoining fixed attachment points 2 are formed at at least one section of the beam 1 length. The points 2 are located in the longitudinal direction of the beam 1 and are formed on the surface or sleeves of the beam 1. The attachment points 2 are interconnected by at least one force exerting element 3 whose straight length, i.e. the direct distance between the two attachment points 2 is shorter than the straight length of the beam 1 between these points 2. Said straight length of the beam 1 is understood to be the length at the stretched or inflated straight beam 1 without applying said force exerting element 3.

In the simple inflated state of the beam 1, i.e. in a state where the beam 1 has been inflated without any external force action, the distance between the two fixed points 2 formed on the surface of the beam 1 is defined by the natural expandability of the hose material or tube material and the internal pressure in the hose or tube acting on the tube walls. After deflation of the beam 1 and installation of the force exerting element 3 interconnecting the fixed attachment points 2 and after re-inflation thereof, deformation, bending, kinking of beam 1 occurs that is directly proportional to the difference in length of the force exerting element 3 and the distance between the fixed points 2 in the simple state of the beam 1. The difference in the shape of the beam 1, compared to the state of the art in FIG. 1, due to the application of the force exerting elements 3, is visible e.g. in FIG. 2 and FIG. 5.

Figure 3:
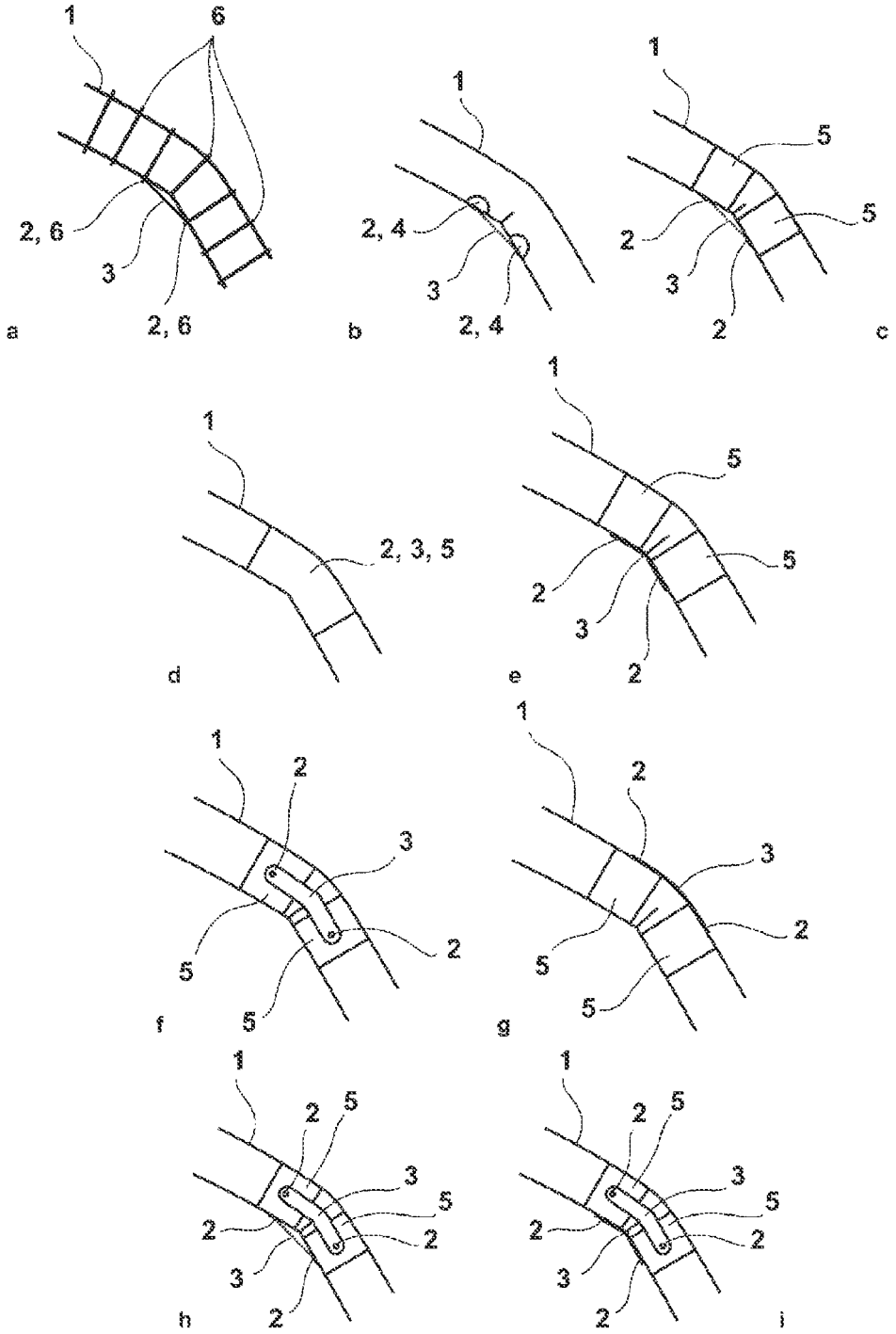
FIG. 3 is a schematic representation of variants a, b, c, d, e, f, g, h, i of the illustrative embodiment of the fixed attachment point and the force exerting element according to the present technical solution.

FIG. 3 shows schematically variants of example embodiments of the fixed attachment points 2, for example in the form of projections 6 formed during the process of braiding of the hose or tube, FIG. 3*a*; by means of additional material 4 applied locally to the surface of the hose or tube; FIG. 3*b*.

This additional material 4 may, for example, also take the form of sleeves 5 applied around the circumference of the hose or tube, FIG. 3*c, d, e, f, g, h, i*. The sleeves 5 can be continuously connected to form one shaped sleeve 5, of rigid material, with a pre-set angle of bending or kinking of the beam 1. Thus, the sleeve 5 also forms a force exerting element 3. This embodiment is shown in FIG. 3*d*.

FIG. 3 also shows variants of example embodiments of the force exerting element 3.

Variants a, b, c represent example embodiments of the force exerting element 3 located only on the inner arc of the beam 1. Variants a, b then show the force exerting element 3 formed as a tensile element; the tensile element may be made of materials such as textile, strap, rope, cord and the like, or also from a rigid material such as metal, wood, hard plastic, and the like. Variant e shows a force exerting element 3 made exclusively as a rigid shaped element. The force exerting element 3 made as a rigid shaped element can also be located on the outer arc of the beam 1 as shown in the variant g.

Variant f represents an example embodiment of a force exerting element 3 formed as a rigid shaped element located on the side of the beam 1. If the force exerting element 3 is located on the side of the beam 1, a symmetrical application of two such force exerting elements 3 formed as a rigid shaped element is presumed preferably.

Variants h, i represent an example embodiment of a combination of force exerting elements 3 located on the inner arc of the beam 1 and at the same time on the side of the beam 1. Variant h specifically illustrates a combination in the case of the use of a force exerting element 3 on the inner arc of the beam 1, where the force exerting element 3 is formed as a tensile element made of a soft or rigid material and the force exerting element 3 on the side of the beam 1 is formed as a rigid shaped element. Variant i specifically illustrates a combination where the force exerting element 3 on the inner arc of the beam 1 is a rigid shaped element. By means of a combination of force exerting elements 3 as shown by the variants h, i in FIG. 3, it is possible to achieve a better lateral stability of the beam 1, in particular in cases of a single standing beam 1 which is not tied to another structure, system or bracing.

It is clear from FIG. 3 that the crucial parameter defining the bending or kinking angle of the beam 1 is not the length of the force exerting element 3 as such, but the direct distance between the two points 2, by which the straight or shaped force exerting element 3 is attached to the fixed attachment points 2 of the beam 1.

The force exerting elements 3 formed as rigid shaped elements, used on the sides or on the upper arc of the beam 1, are shaped in accordance with the predetermined angle of bending or kinking of the beam 1. The most preferable material in this case is metal strip that is bent, for application to the outer or inner arc of the beam 1, or cut, for application onto the side of the beam 1, to a shape that takes into account the desired angle of bending or kinking of the beam 1.

Figure 4:
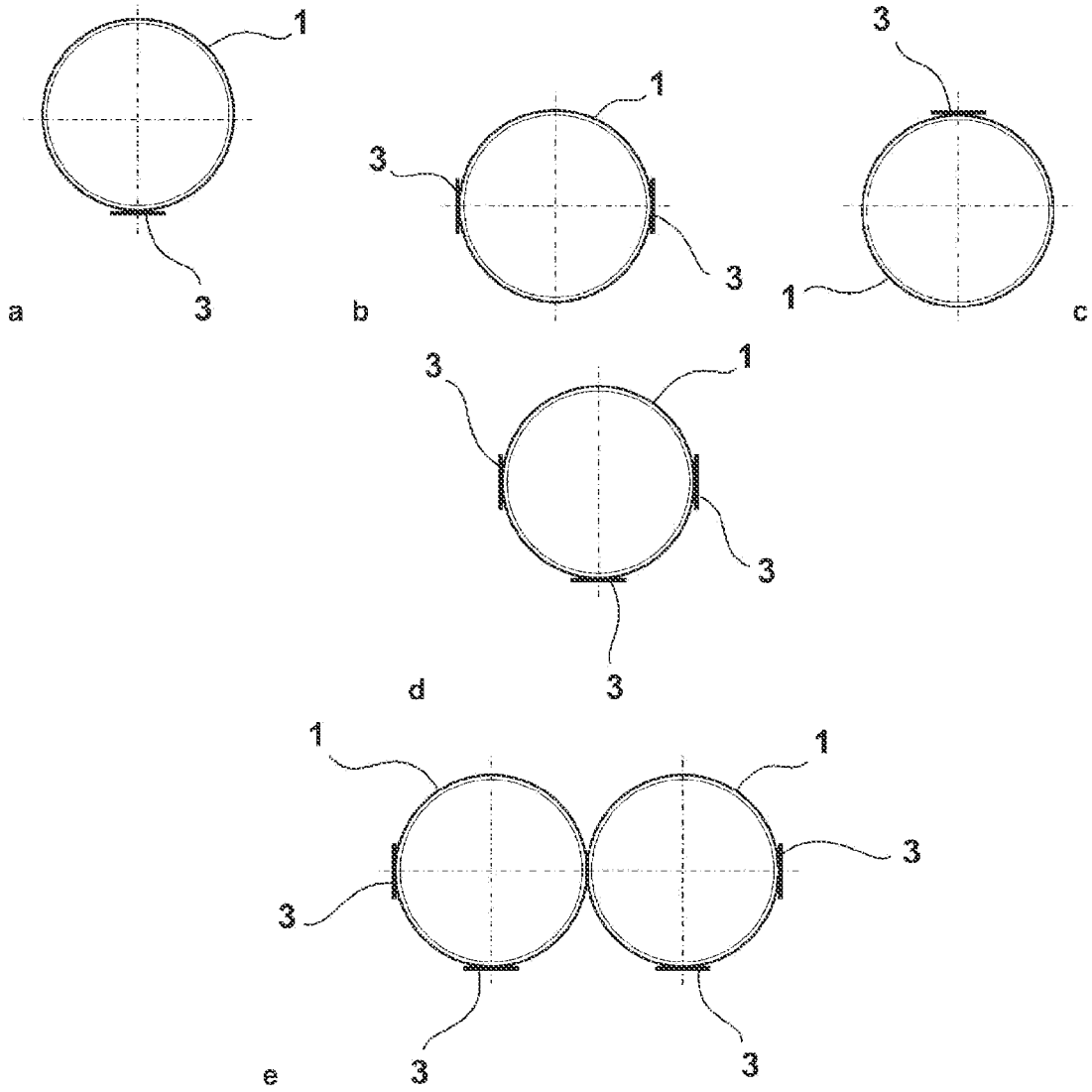
FIG. 4 is a schematic representation of variants a, b, c, d of examples of the positioning the force exerting element on a single or double hose or tube of a beam according to the present technical solution.

FIG. 4 schematically shows variants of examples of locations of the force exerting element 3 on the hose or tube which is simple hose or tube, variant a, b, c, d, and double hose or tube, variant e, respectively. FIG. 4, variants a, b, c, d are in fact transversal cross-sections of the beam 1 at the location of the force exerting element 3, from the respective variants of FIG. 3. The position of the force exerting element 3 is shown schematically, i.e. only the position relative to the beam 1 is indicated, not the actual embodiment of the particular variant of the coupling element 3. Variant e shows a combination of the force exerting elements 3 located on the side of the beam 1, which is an assembly of two coaxial hoses or tubes. In this variant, it is necessary that the force exerting element 3 is applied on each hose or tube.

FIG. 5 then shows a schematic view of variants a, b, examples of various beam shapes obtainable by this technical solution.

FIG. 6 illustrates an example use of a high-pressure inflatable beam 1 according to the present technical solution as a beam of a tunnel-type tent, where the underpassability at the longitudinal walls of the tent is improved.

The example embodiments described above are given by way of illustration only, without limiting in any way the scope of protection defined by the claims. It is obvious that by making use of the principles set forth in the present solution, it is possible to form a large number of embodiments and applications of a bent or kinked high pressure inflatable beam apart from those described as specific example uses of the beam according to this technical solution. These other embodiments and applications result in particular from various other possible combinations of positions and the number of the force exerting elements 3 on the beam 1.

Thus, the arcuate high pressure inflatable beam 1 according to the present solution provides a wide variety of shape possibilities for the beam 1 and the associated application possibilities in places where a continuously arcuate beam appears to be insufficient or inconvenient.

The invention claimed is:

1. A high pressure inflatable beam comprising: an internal operating pressure in the range of 100 to 1,000 kPa, formed from hoses or tubes produced by seamless braiding technology with an internal lining impervious to air and an outer protective coat, the ends of which are closed by a plug, wherein at least one plug contains at least one filling or discharging element for a filling medium, and the ends of the beam are firmly put in at a distance of less than the total length of the beam, wherein at at least one section of its length, the beam is provided with at least two adjoining fixed attachment points located in the longitudinal direction of the beam and formed on the surface of the beam at the outer protective coat apart from the internal lining, wherein the fixed attachment points are interconnected by at least one force exerting element along the longitudinal direction, whose straight length between the fixed attachment points is shorter than the straight length of the plain beam between these fixed attachment points, wherein the fixed attachment points comprise one or more sleeves encircling a longitudinal portion of the surface of the beam at the outer protective coat, wherein the fixed attachment points hold a continuously arcuate shape in the high pressure inflatable beam across the total length of the beam, wherein the one or more sleeves comprise a textile material and define a non-parallel preset angle in the high pressure inflatable beam such that the one or more sleeves are disposed on opposite longitudinal ends of the non-parallel preset angle, and wherein the outer protective coat comprises a fabric surrounding the internal liner and defining a continuous straight length between the fixed attachment points.

2. The high pressure inflatable beam according to claim 1, wherein the fixed attachment points and the force exerting element are located on the inner arc of the beam.

3. The high pressure inflatable beam according to claim 2, wherein the force exerting element is a rigid shaped element or a tensile element extending directly from one fixed attachment point of the at least two adjoining fixed attachment points to another fixed attachment point of the at least two adjoining fixed attachment points.

4. The high pressure inflatable beam according claim 1, wherein the fixed attachment points and the force exerting element are located on the sides of the beam.

5. The high pressure inflatable beam according to claim 1, wherein the fixed attachment points and the force exerting element are located on the outer arc of the beam.

6. The high pressure inflatable beam according to claim 1, wherein the fixed attachment points and the force exerting element are located on the inner arc of the beam, or at least one side of the beam, or on the outer arc of the beam.

7. The high pressure inflatable beam according to claim 6, wherein the force exerting element on the inner arc of the beam is a rigid shaped element or a tensile element extending directly from one fixed attachment point of the at least two adjoining fixed attachment points to another fixed attachment point of the at least two adjoining fixed attachment points, the force exerting element on the side of the beam is a rigid shaped element which has an angle corresponding to the angle of bending or kinking of the beam, and the force exerting element on the outer arc of the beam is a rigid shaped element which has an angle corresponding to the angle of bending or kinking of the beam.

8. A high pressure inflatable beam extending longitudinally along a total length between a first end and a second end, the high pressure inflatable beam comprising:

an internal lining containing a pressurized medium at an operating pressure in the range of 100 to 1,000 kPa;

a seamlessly braided outer protective coat surrounding the internal lining and defining a surface radially outward from the internal lining;

a first plug closing the first end;

a second plug closing the second end;

at least two adjoining fixed attachment points formed on the surface of the beam at the seamlessly braided outer protective coat apart from the internal lining, the at least two adjoining fixed attachment points being spaced apart by an arc segment having a plain beam straight length along the longitudinal direction of the high pressure inflatable beam, the plain beam straight length being less than the total length of the high pressure inflatable beam;

a force exerting element holding the arc segment as a kinked portion of the high pressure inflatable beam, the force exerting element interconnecting the at least two adjoining fixed attachment points and having a straight length between the at least two adjoining fixed attachment points, the straight length of the force exerting element being shorter than the plain beam straight length along the longitudinal direction and thereby defining a preset angle of the arc segment, wherein the fixed attachment points comprise one or more sleeves encircling a longitudinal portion of the outer surface of the outer protective coat, wherein the fixed attachment points hold a continuously arcuate shape in the high pressure inflatable beam across the total length of the beam, wherein the one or more sleeves comprise a textile material and define a non-parallel preset angle in the high pressure inflatable beam such that the one or more sleeves are disposed on opposite longitudinal ends of the non-parallel preset angle, and wherein the outer protective coat comprises a fabric surrounding the internal liner and defining a continuous straight length between the fixed attachment points.

9. The high pressure inflatable beam of claim 8, wherein the force exerting element is a tensile element defining the preset angle in tandem with inflation of the internal lining and the seamlessly braided outer protective coat, the tensile element extending directly from one fixed attachment point of the at least two adjoining fixed attachment points to another fixed attachment point of the at least two adjoining fixed attachment points.

10. The high pressure inflatable beam of claim 8, wherein the fixed attachment points and the force exerting element are located on the sides of the beam.

11. A high pressure inflatable beam extending longtidinally along a total length between a first end and a second end, the high pressure inflatable beam comprising:

an internal lining containing a pressurized medium at an operating pressure in the range of 100 to 1,000 kPa;

a seamlessly braided outer protective coat surrounding the internal lining and defining a surface radially outward from the internal lining;

a first plug closing the first end;

a second plug closing the second end;

at least two adjoining fixed attachment points formed on the surface of the beam at the seamlessly braided outer protective coat apart from the internal lining, the at least two adjoining fixed attachment points being spaced apart by an arc segment having a plain beam straight length along the longitudinal direction of the high pressure inflatable beam, the plain beam straight length being less than the total length of the high pressure inflatable beam;

a force exerting element holding the arc segment as a kinked portion of the high pressure inflatable beam, the force exerting element interconnecting the at least two adjoining fixed attachment points and having a straight length between the at least two adjoining fixed attachment points, the straight length of the force exerting element being shorter than the plain beam straight length along the longitudinal direction and thereby defining a non-parallel preset angle of the arc segment, wherein each fixed attachment point comprises a sleeve comprising a textile material encircling a longitudinal portion of the outer surface of the outer protective coat such that the sleeves with the force exerting element maintain the non-parallel preset angle in the high pressure inflatable beam, wherein the sleeves are disposed on opposite longitudinal ends of the non-parallel preset angle, wherein the outer protective coat comprises a fabric surrounding the internal liner and defining a continuous straight length between the fixed attachment points, the continuous straight length being bent to the non-parallel preset angle by the force exerting element, and wherein the force exerting element is a tensile element defining the preset angle in tandem with inflation of the internal lining and the seamlessly braided outer protective coat, the tensile element extending directly from one fixed attachment point of the at least two adjoining fixed attachment points to another fixed attachment point of the at least two adjoining fixed attachment points.

* * * * *